United States Patent [19]

Jacobson

[11] Patent Number: 4,498,235

[45] Date of Patent: Feb. 12, 1985

[54] RAZOR BLADE ASSEMBLY

[75] Inventor: Chester F. Jacobson, Southboro, Mass.

[73] Assignee: The Gillette Company, Boston, Mass.

[21] Appl. No.: 519,565

[22] Filed: Aug. 2, 1983

Related U.S. Application Data

[63] Continuation-in-part of Ser. No. 419,202, Sep. 17, 1982.

[51] Int. Cl.[3] ..... B26B 21/22

[52] U.S. Cl. ..... 30/47; 30/87

[58] Field of Search ..... 30/89, 50, 32, 43.1, 30/63, 47, 77, 87

[56] References Cited

U.S. PATENT DOCUMENTS

| | | | |
|---|---|---|---|
| 3,724,070 | 4/1973 | Dorion | 30/47 |
| 3,935,639 | 2/1976 | Terry | 30/47 |
| 3,938,247 | 2/1976 | Carbonell | 30/57 X |
| 3,950,849 | 4/1976 | Perry | 30/47 |
| 4,026,016 | 5/1977 | Nissen | 30/47 |
| 4,083,104 | 4/1978 | Nissen | 30/47 |
| 4,168,571 | 9/1979 | Francis | 30/47 |
| 4,266,340 | 5/1981 | Bowman | 30/89 |
| 4,270,268 | 6/1981 | Jacobson | 30/47 |
| 4,347,663 | 9/1982 | Ullmo | 30/47 |

*Primary Examiner*—Jimmy C. Peters

*Attorney, Agent, or Firm*—Scott R. Foster

[57] ABSTRACT

A razor blade assembly comprising a blade disposed between skin engaging elements adapted in operation to engage a surface being shaved ahead and behind, respectively, of the blade, the blade being movable relative to the elements in response to forces encountered during a shaving operation, the blade assembly having pivot mountings thereon for pivotal attachment to a razor handle, whereby the blade assembly, as a whole, may be pivotally movable on a handle in response to forces encountered during the shaving operation.

1 Claim, 7 Drawing Figures

RAZOR BLADE ASSEMBLY

CROSS-REFERENCE TO RELATED APPLICATION

This is a continuation-in-part of application Ser. No. 419,202, filed Sept. 17, 1982 in the name of Chester E. Jacobson.

BACKGROUND OF THE INVENTION

1. Field of the Invention

The invention relates to wet shaving implements and is directed more particularly to a blade assembly which, as a whole, is movable on a handle assembly during a shaving operation, and having individual blade assembly components which are independently movable during the shaving operation.

2. Description of the Prior Art

It is known in the art to provide a razor blade assembly which may be connected to, and used in conjunction with, a razor handle to facilitate shaving operations. U.S. Pat. No. 3,724,070, issued Apr. 3, 1973, in the name of Francis W. Dorion, Jr. shows a blade assembly in which blade means are held between blade assembly surfaces adapted to engage the surface being shaved in front of and behind, respectively, cutting edge portions of the blade means. Such surfaces are generally referred to as "guard" and "cap".

It is further known that shaving efficiency of such a safety razor assembly may be improved if the blade assembly is adapted to pivot on the razor handle during a shaving operation, permitting the blade assembly to more closely follow the contours of a surface being shaved. U.S. Pat. No. 3,935,639, issued Feb. 3, 1976, in the name of John C. Terry, et al, and U.S. Pat. No. 3,938,247, issued Feb. 17, 1976, in the name of Nelson C. Carbonell, et al, are illustrative of razor handles adapted to accept the blade assembly of U.S. Pat. No. 3,724,070 in such a manner as to permit pivotal movement of the blade assembly during a shaving operation. U.S. Pat. No. 3,950,849, issued Apr. 20, 1976, in the name of Roger L. Perry, illustrates a modified blade assembly adapted for pivotal movement. U.S. Pat. No. 4,026,016, issued May 31, 1977, in the name of Warren I. Nissen, and U.S. Pat. No. 4,083,104, issued Apr. 11, 1978, in the name of Warren I. Nissen, illustrate, respectively, a blade assembly and razor handle comprising a shaving system in which the blade assembly pivots on the handle during shaving. The shaving system shown in U.S. Pat. Nos. 4,026,016 and 4,083,104 has become well known world-wide.

Another means by which increased shaving efficiency may be obtained is that of retaining the blade assembly, as a whole, stationary but permitting movement of individual components thereof in response to forces encountered during shaving. In U.S. Pat. No. 4,168,571, issued Sept. 25, 1979, in the name of John F. Francis, there is shown a blade assembly in which the guard, cap and blade means are each movable independently of each other in dynamic fashion. U.S. Pat. No. 4,270,268, issued June 2, 1981, in the name of Chester F. Jacobson, shows a blade assembly in which the guard and blade means are independently movable.

In U.S. Patent application Ser. No. 419,202, filed Sept. 17, 1982, in the name of Chester F. Jacobson, there is disclosed a safety razor blade assembly adapted for pivotal movement, as a whole, on a razor handle during a shaving operation, and further having blade means movable within the blade assembly in response to forces encountered during a shaving operation.

SUMMARY OF THE INVENTION

An object of the present invention is to provide an improved safety razor blade assembly of the type disclosed in the above referred to U.S. Ser. No. 419,202.

With the above and other objects in view, as will hereinafter appear, a feature of the present invention is the provision of a safety razor blade assembly comprising blade means having cutting edge means disposed between skin engaging elements adapted in operation to engage a surface being shaved ahead of and behind, respectively, the cutting edge means, the blade means being movable relative to the elements in response to forces encountered during a shaving operation, the blade assembly having pivot mounting means thereon for pivotal attachment to a razor handle assembly, whereby the blade assembly, as a whole, is pivotally movable on said handle assembly in response to forces encountered during the shaving operation.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
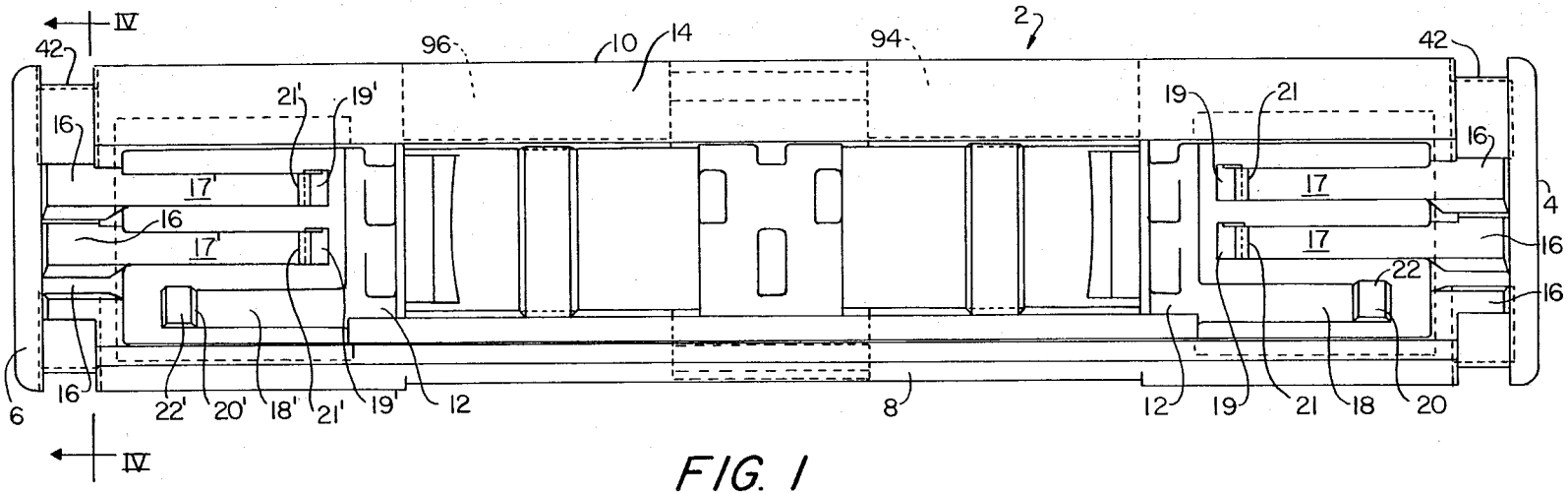
FIG. 1 is a top plan view of a housing portion of one form of blade assembly illustrative of an embodiment of the invention.

Referring to the drawings, it will be seen that the illustrative razor blade assembly includes a body member 2 having first and second end portions 4, 6 interconnected by front and back wall portions 8, 10. Frame portions 12 extend width-wise of the body member, interconnecting the front and back walls 8, 10.

The back wall portion 10 of the body member 2 has an upper portion 14 which engages skin being shaved behind the cutting means of the assembly, thereby fulfilling the functions and occupying the position of the "cap" portion of conventional razor blade assemblies. Such portion 14 shall, for that reason, be referred to hereinafter as the "cap portion".

Each of the end portions 4, 6 is provided with opposed slots 16 disposed transversely to the frame portions 12. One of the frame portions 12 near the first end portion 4 is provided with a spring finger 18 extending therefrom generally parallel to the front and back walls 8, 10. The finger 18 is provided with an upturned end portion 20 having an upper surface 22. In like manner, another of the frame portions 12 near the second end portion 6 is provided with a spring finger 18' of similar configuration, with upturned end portions 20' having upper surfaces 22'. The fingers 18, 18' extend in opposite directions, the finger 18 extending toward the first end portion 4 of the body member 2 and the finger 18' extending toward the second end portion 6 of the body member. The fingers 18 and 18' are aligned with each other and with a pair of the slots 16. The first end portion 4 is provided with spring fingers 17 extending therefrom inwardly and upwardly of the body member, as viewed in FIGS. 1 and 2. Each of the fingers 17 is provided with an upturned end portion 19 having an upper surface 21. In like manner, the second end portion 6 is provided with spring fingers 17' of similar configuration, with upturned end portions 19' having upper surfaces 21'. The fingers 17, 17' extend in generally opposite directions, the fingers 17 extending from the first end portion 4 generally toward the second end portion 6, and the fingers 17' extending from the second end portion 6 generally toward the first end portion 4. The fingers 17, 17' are each aligned with a pair of the slots 16.

The assembly includes a guard portion 24 having a slide member 26 at either end thereof. The slide members 26 are received in a pair of opposed slots 16 nearest the front wall portion 8. The bottom of the guard portion rests upon the surfaces 22, 22' of the spring fingers 18, 18'. The lower edges of the slide members 26 rest above the bottoms of their slots 16, allowing the guard portion 24 to be moved further into the slots, against the bias of the spring fingers 18, 18' therebeneath. The spring fingers supporting the guard portion comprise a set of spring fingers, the object of which is to resiliently support the guard portion. In a shaving operation, the guard portion travels over the surface being shaved ahead of the cutting means.

The assembly further includes blade means 28 comprising a blade base portion 30, a cutting edge portion 32 extending from the base portion, and slide portions at either end of the base portion. The slide portions which may be merely extensions of the blade base portions 30, are received in a pair of the opposed slots 16. An underside 34 of the blade cutting edge portion 32 is engaged by the surfaces 21, 21' of a pair of the spring fingers 17, 17'. Lower edges of the slide portions are spaced from the bottoms of their slots to permit movement of the blades further into the slots 16 against the bias of the spring fingers 17, 17' on which the blade base portion rests. The spring fingers supporting the blade base portion 30 comprise another set of spring fingers, the object of which is to resiliently support the blade means thereon.

In the embodiment illustrated, the blade means include a second blade 28' having a base portion 30', a cutting edge portion 32', and slide portions all anchored similarly to the above-described first blade means. The slide portions of the second blade are received in a third pair of the opposed slots 16 nearest the cap portion 14 with the base portion 30' resting upon spring finger surfaces 21, 21'. The spring fingers supporting the second blade comprise still another set of spring fingers, which resiliently support the second blade. In a shaving operation, the second blade travels over the surface being shaved behind the first blade.

The guard portion 24, first and second blades 28, 28' are clamped in place by spring clamps 40, which are received in slots 42 in the end portions 4, 6. The clamps 40 engage the guard portion 24 and blades 28, 28' forcing them into the slots 16 to a point where a slight stress is placed on the spring fingers.

Figure 2:
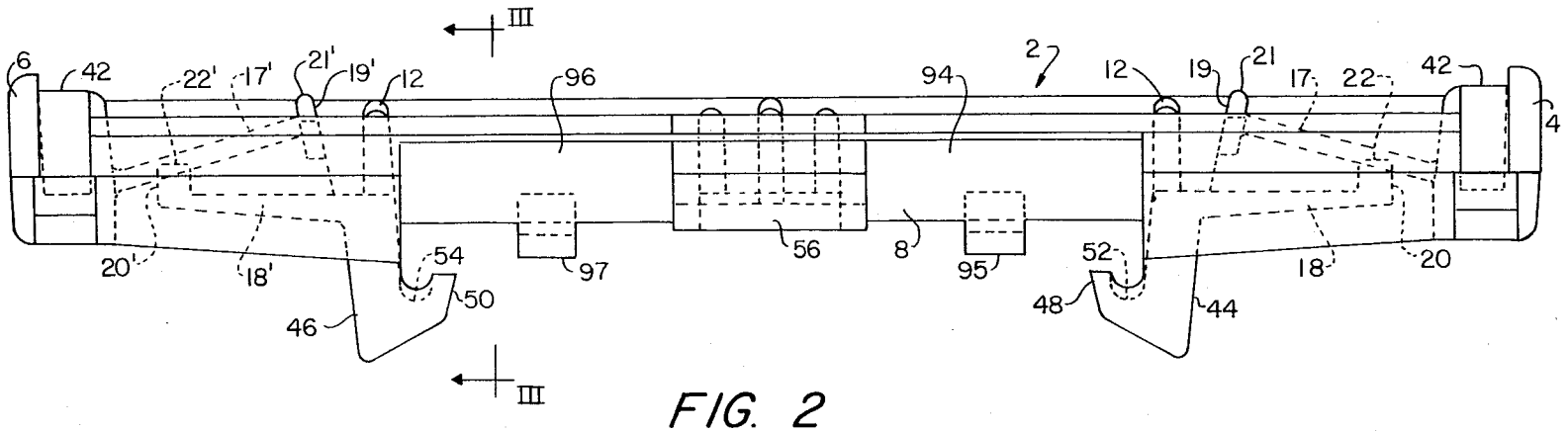
FIG. 2 is a front elevational view thereof.
Figure 3:
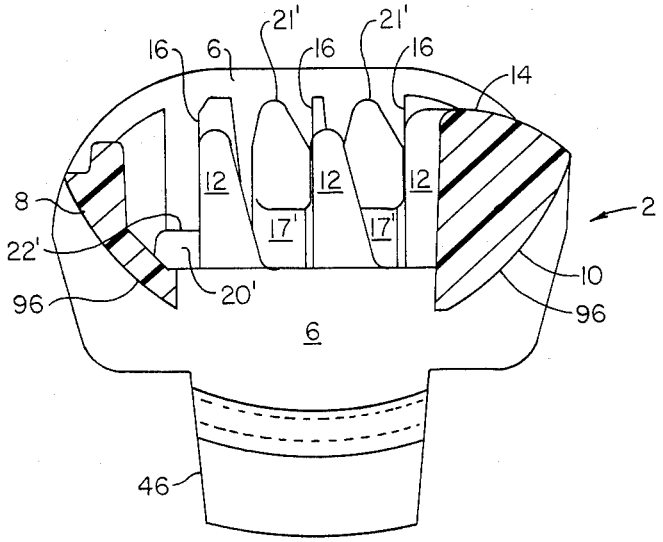
FIG. 3 is a sectional view taken along line III—III of FIG. 2.
Figure 4:
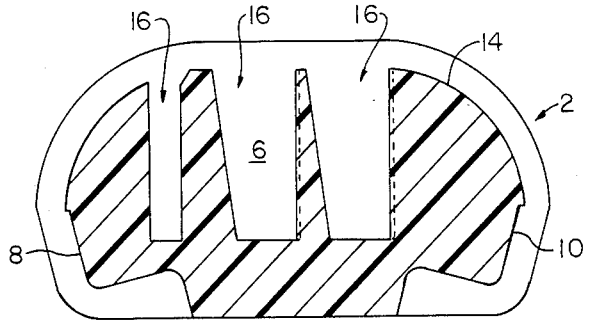
FIG. 4 is a sectional view taken along line IV—IV of FIG. 1.
Figure 5:
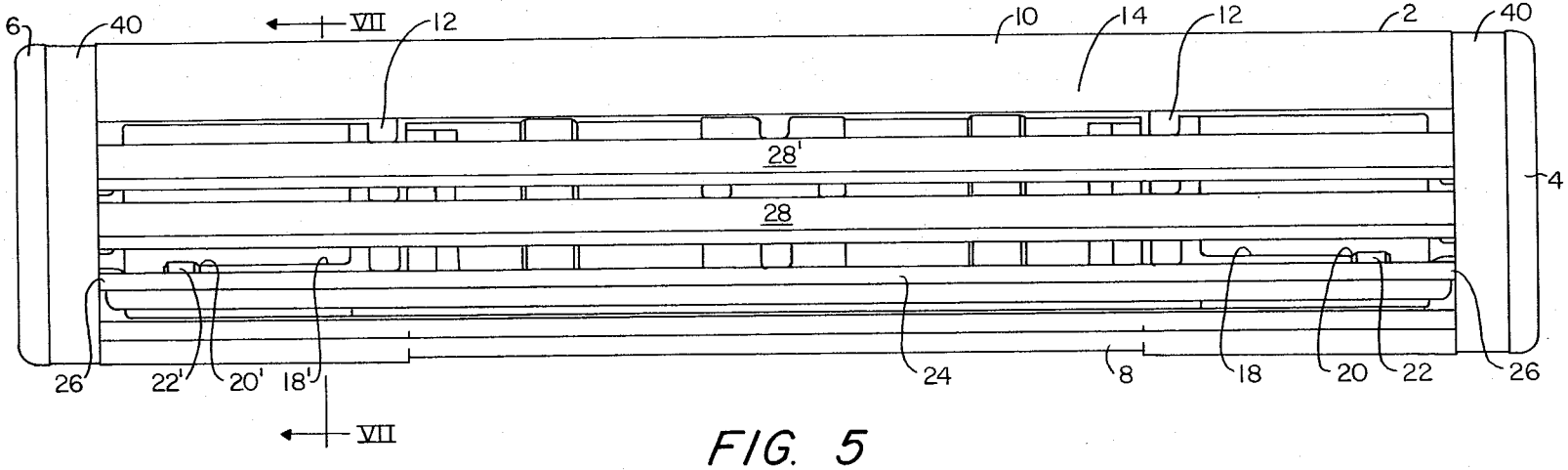
FIG. 5 is a top plan view of one form of blade assembly illustrative of an embodiment of the invention.
Figure 6:
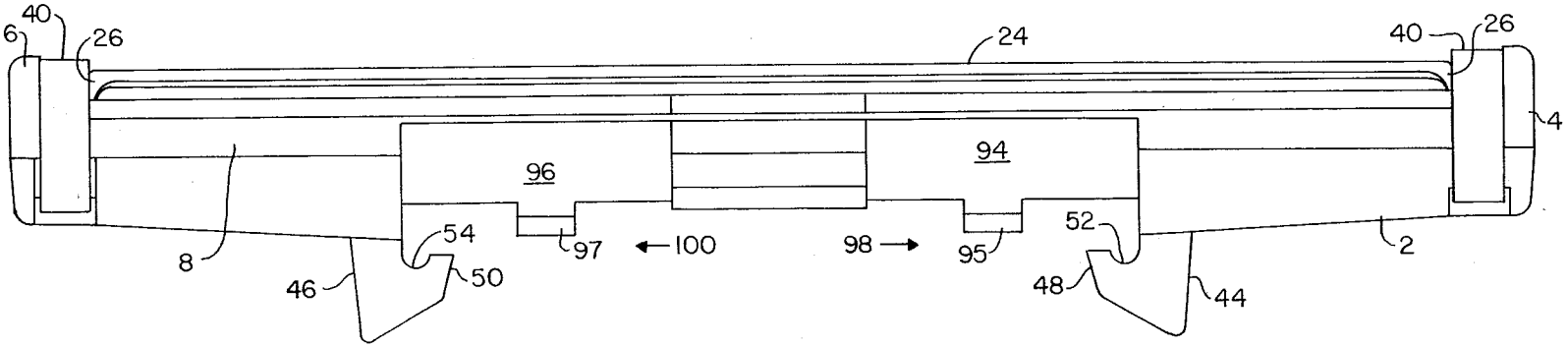
FIG. 6 is a front elevational view thereof.
Figure 7:
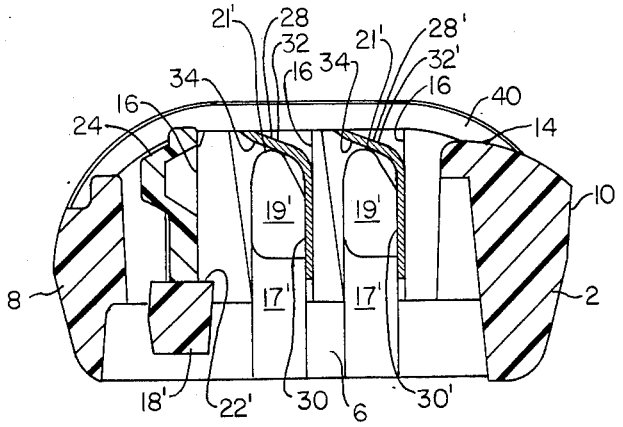
FIG. 7 is a sectional view of the blade assembly, taken along line VII—VII of FIG. 5.

On the underside of the body member 2 and the frame portions 12, are disposed two extensions 44, 46 having at their free ends, respectively, inwardly extending opposed rails 48, 50, each rail having respective arcuate upper surfaces 52, 54. The extensions comprise a pivot mounting means by which the blade assembly may be removably and pivotally attached to a razor blade. Referring to FIGS. 2 and 6, it will be seen that the blade assembly body member underside is additionally provided with cam means 56 adapted to receive a cam follower operative to urge the blade assembly to a given position.

Referring again to FIGS. 2 and 6, it will be seen that the blade assembly rails 48, 50, in conjunction with undersurfaces 94, 96 of the body member 2, and arcuate struts 95, 97, define arcuate slots 98, 100 adapted to receiver razor handle shell bearings (not shown). The shell bearings comprise a pivot mounting means adapted to cooperate with the above described blade assembly pivot mounting means to facilitate pivotal connection of the blade assembly to the razor handle assembly.

In the handle there is disposed a coil spring and a plunger member the spring biasing the plunger in the direction of the free end of the plunger member. When the blade assembly is connected to the handle assembly, the free end of the plunger member is urged by the spring into engagement with the blade assembly cam means 56. During pivoting operation of the blade assembly, the plunger end bears against the cam means 56, to urge the blade assembly to a given position.

During a shaving operation, the guard portion 24 and the blades 28, 28' move independently of each other against the bias of the spring fingers. Simultaneously, the blade assembly, as a whole, pivots on the handle, following the contours of the surface being shaved.

It is to be understood that the present invention is by no means limited to the particular construction herein disclosed and/or shown in the drawings, but also comprises any modifications or equivalents within the scope of the disclosure. For example, it is preferable under certain conditions that the guard portion be immovable. An alternative embodiment includes a guard portion fixed immovably to the blade assembly body member, but in all other respects structured and operated in accordance with the above description. As a further example, the blade means may include a single blade, rather than the two blade arrangement described, the single blade being used in conjunction with either a movable or stationary guard portion.

What is claimed is:

1. A razor blade assembly comprising a body member having first and second end portions interconnected by front and back wall portions, first and second frame portions interconnecting said front and back wall portions, said end portions having therein opposed slots, a first pair of spring fingers extending outwardly from said frame portions parallel to said front and back wall portions and in opposite directions, said fingers being aligned with a first pair of said slots, a second pair of spring fingers extending inwardly from said end portions, and in generally opposite directions toward one another, said second pair of spring fingers being aligned with a second pair of said slots, a third pair of spring fingers extending inwardly from said end portions, and in generally opposite directions toward one another, said third pair of spring fingers being aligned with a third pair of said slots, a quard portion mounted on said first pair of spring fingers and disposed in said first pair of slots, and first and second blade members having, respectively, first and second cutting edges parallel with each other and facing a same direction to act in tandem upon a surface being shaved, said blade members being disposed in said second and third pairs of slots, respectively and resting upon said second and third pairs of spring fingers, respectively, said first and second blade members and said guard portions each being independently movable relative to the body member in response to forces encountered during a shaving operation by flexure of said spring fingers, the blade assembly having pivot mounting means thereon for pivotal attachment to a razor handle assembly, whereby the blade assembly, as a whole, is pivotally movable on said handle assembly in response to forces encountered during the shaving operation, and cam means disposed on an underside of said body member and adapted to receive a cam follower mounted on said razor handle to maintain maximum contact between said surface being shaved and said independently movable first and second blade members and guard portion.

* * * * *